US006474494B1

(12) United States Patent
Miller

(10) Patent No.: US 6,474,494 B1
(45) Date of Patent: Nov. 5, 2002

(54) BEVERAGE CONTAINER COVER BOWL

(75) Inventor: Thomas Miller, West Bend, WI (US)

(73) Assignee: Thomas H. Miller, West Bend, WI (US)

( * ) Notice: Subject to any disclaimer, the term of this patent is extended or adjusted under 35 U.S.C. 154(b) by 0 days.

(21) Appl. No.: 09/310,215

(22) Filed: May 12, 1999

(51) Int. Cl.[7] ..... B65D 55/00

(52) U.S. Cl. ..... 220/379; 206/217; 206/806; 220/23.86

(58) Field of Search ..... 220/707, 709, 220/574, 379, 744, 375, 840, 23.83, 23.86; 206/217, 806; 215/399

(56) References Cited

U.S. PATENT DOCUMENTS 285,645 A * 9/1883 Milligan et al. ..... 220/694
1,155,261 A * 9/1915 Mitchell ..... 217/81
2,090,937 A * 8/1937 Cohen ..... 150/123
3,737,093 A * 6/1973 Amberg et al. ..... 206/447
4,781,321 A * 11/1988 Koyata et al. ..... 220/574 X
5,180,079 A * 1/1993 Jeng ..... 220/709 X

* cited by examiner

*Primary Examiner*—Allan N. Shoap
*Assistant Examiner*—Joe Merek

(57) ABSTRACT

A beverage container cover with bowl (10) having a cover (12) which comprises a cover bottom (12B) having a hollow cover bottom male member (12B) extending upwardly therefrom. The cover bottom (12B) is securely sealably affixed to a cover side (12A) having a cover side lip (12AA) around a top distal edge thereof. The cover side lip (12AA) having a complementary configuration and size to a beverage container lip (18A) of a beverage container (18). A bowl (14) which comprises a bowl bottom (14B) having a hollow bowl bottom female member (14BA) having a complementary configuration and size to the cover bottom male member (12B) insertable therein. The bowl (14) further comprises a bowl side (14A) having a bowl side lip (14AA) around a top distal edge thereof.

2 Claims, 4 Drawing Sheets

BEVERAGE CONTAINER COVER BOWL

BACKGROUND OF THE INVENTION

1. Field of the Invention

The present invention relates to beverage container covers. More particularly, the present invention relates to beverage container cover with a bowl intricately molded therein.

2. Description of the Prior Art

Numerous innovations for beverage container covers have been provided in the prior art that are described as follows. Even though these innovations may be suitable for the specific individual purposes to which they address, they differ from the present invention as hereinafter contrasted.

In U.S. Pat. No. 5,853,104, titled Combination Food Plate and Beverage-holding Article, invented by Kris M. Rathjen, a combined food plate and beverage-holding article is described which comprises a generally flat compartmentalized rib-reinforced plate body having an upstanding truncated cone. The cone has an open upper end for receiving a beverage container. A support base is pivoted inside the member between a first position lying horizontal adjacent the base of member 14 to support a beverage container received through the upper opening and a second position lying against an interior wall of the member for use with stem glasses wherein the bowl may be supported by the upper margin of the member and the flat base of the stem glass to extend through the open lower end of the member. The support base may be locked in a first position and releasably retained in its second position. A slot is formed adjacent the base of member 14 for receiving and supporting the flat base of a stem glass having a bowl smaller in diameter than the diameter of the upper opening of the member.

The patented invention differs from the present invention because the patented invention is a generally flat compartmentalized rib-reinforced plate body having an upstanding truncated cone. The cone supports a beverage container. A support base is pivoted inside the cone functioning to provide a base to support a first style of drinking vessel which is smaller in diameter than the inner diameter of the cone. The upper rim of the cone is sized to grasp a rim of a second style of drinking vessel which is larger in diameter than the cone. The support base may be locked in a first position and releasably retained in its second position. A slot is formed adjacent the base of member for receiving and supporting the flat base of a stem glass having a bowl smaller in diameter than the diameter of the upper opening of the member. The patented invention lacks a means of attaching the plate body to the upper portion of a drinking vessel. Further, the Patented invention requires to user to support the plate body which supports the beverage container which is awkward an due to the cantilever leads to instability. The present invention has no moving parts and is simpler to form. The present invention provides access to a beverage container through a straw without removing the beverage container.

In Patent Number D400,402, titled Sampler Bowl, invented by Gene L. Petkovich, Jr., an ornamental design for a sampler bowl is described.

The patented invention differs from the present invention because the patented invention is an ornamental design for a sampler bowl. The bowls are removably attached to a holder. The patented invention lacks features similar to the present invention.

In U.S. Pat. No. 5,753,289, titled Portable Food Container and Method for Storing and Dispensing Dry and Liquid Food, invented by Richard B. Ness, a portable food container for use in holding dry and liquid foods for consumption. The container allows an individual to consume a combination of dry cereal and cold milk in a remote location away from the kitchen without the use of a bowl and a spoon. The portable food container is inverted to allow dry cereal to flow therefrom, and squeezed to allow milk to flow therefrom.

The patented invention differs from the present invention because the patented invention is a portable food container for use in holding dry and liquid foods for consumption. The portable food container is inverted to allow dry cereal to flow therefrom, and squeezed to allow milk to flow therefrom. The patented invention lacks features similar to the present invention.

In Patent Number D351,531, titled Stadium Simulating Transparent Bowl, invented by Raymond Brennan, an ornamental design for a stadium simulating transparent bowl, as shown and described.

The patented invention differs from the present invention because the patented invention is an ornamental design for a stadium simulating transparent bowl. The patented invention lacks features similar to the present invention.

In U.S. Pat. No. 4,106,658, titled Platter, invented by Richard N. Brandon, a heat retention individual serving platter has a stainless steel tray-shaped insert integrally attached to and supported on a rigid nylon filled foam underlying base. The insert is formed with a downwardly turned edge having an outwardly extending locking portion which extends into the plastic material of the base and which locks the insert in place.

The patented invention differs from the present invention because the patented invention is a heat retention individual serving platter has a stainless steel tray-shaped insert integrally attached to and supported on a rigid nylon filled foam underlying base. The insert is formed with a downwardly turned edge having an outwardly extending locking portion which extends into the plastic material of the base and which locks the insert in place. The present invention is a device which solves the problem of holding snacks and drinks in one hand while providing the user unrestricted access to both. The present invention has a disk having an attachment means on a bottom side which cooperates with the upper rim of a drinking cup to removably attach the disk to the rim. A first hollow cylinder is securely attached centrally to the upper surface of the disk and defines an aperture through which a straw is passed to provide access to food products retained in the drinking cup. A complementary bowl is formed functioning to be inserted into the upper portion of the disk and removably attached to the disk by an attachment means. The bowl has a second hollow cylinder which is securely attached, centrally, to the inner surface of the bowl. The second hollow cylinder is sized to telescope and be in alignment with the first hollow cylinder. The second hollow cylinder is positioned to cooperate with the first hollow cylinder permitting a straw to be passed functioning to provide access to a food product retained with in the drinking cup.

Numerous innovations for beverage container cover have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to beverage container covers. More particularly, the present invention relates to beverage container cover with a bowl intricately molded therein.

The types of problems encountered in the prior art are beverage containers and bowls are separate requiring two hands to use or carry.

In the prior art, unsucessful attempts to solve this problem were attempted namely: beverage containers with large lids. However, the problem was solved by the present invention because the beverage container lid has a bowl intricately molded therein.

Innovations within the prior art are rapidly being exploited in the field of beverage container lids.

The present invention went contrary to the teaching of the art which describes and claims separate lids and bowls.

The present invention solved a long felt need for a beverage container lid having a bowl attached thereto.

Accordingly, it is an object of the present invention to provide a beverage container cover with bowl having a cover, bowl, and a lid.

More particularly, it is an object of the present invention to provide a cover having a cover side with a cover side lip and a cover bottom with a cover bottom male member.

In keeping with these objects, and with others which will become apparent hereinafter, one feature of the present invention resides, briefly stated, in the bowl having a bowl side and a bowl bottom.

When the bowl side is designed in accordance with the present invention, it comprises a bowl side lip and a bowl side fastener.

In accordance with another feature of the present invention, the bowl bottom comprises a bowl bottom female member and a bowl bottom skirt.

Another feature of the present invention is that the lid comprises a lid top with a lid top opening, a lid lip, and a lid fastener.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—beverage container cover with bowl (10)
12—cover (12)
12A—cover side (12A)
12AA—cover side lip (12AA)
12B—cover bottom (12B)
12BA—cover bottom male member (12B)
14—bowl (14)
14A—bowl side (14A)
14AA—bowl side lip (14AA)
14AB—bowl side fastener (14AB)
14B—bowl bottom (14B)
14BA—bowl bottom female member (14BA)
14BB—bowl bottom skirt (14BB)
16—lid (16)
16A—lid (16A)
16AA—lid opening (16AA)
16B—lid lip (16B)
16C—lid fastener (16C)
18—beverage container (18)
18A—beverage container lip (18A)

DESCRIPTION OF THE PREFERRED EMBODIMENT

Figure 1:
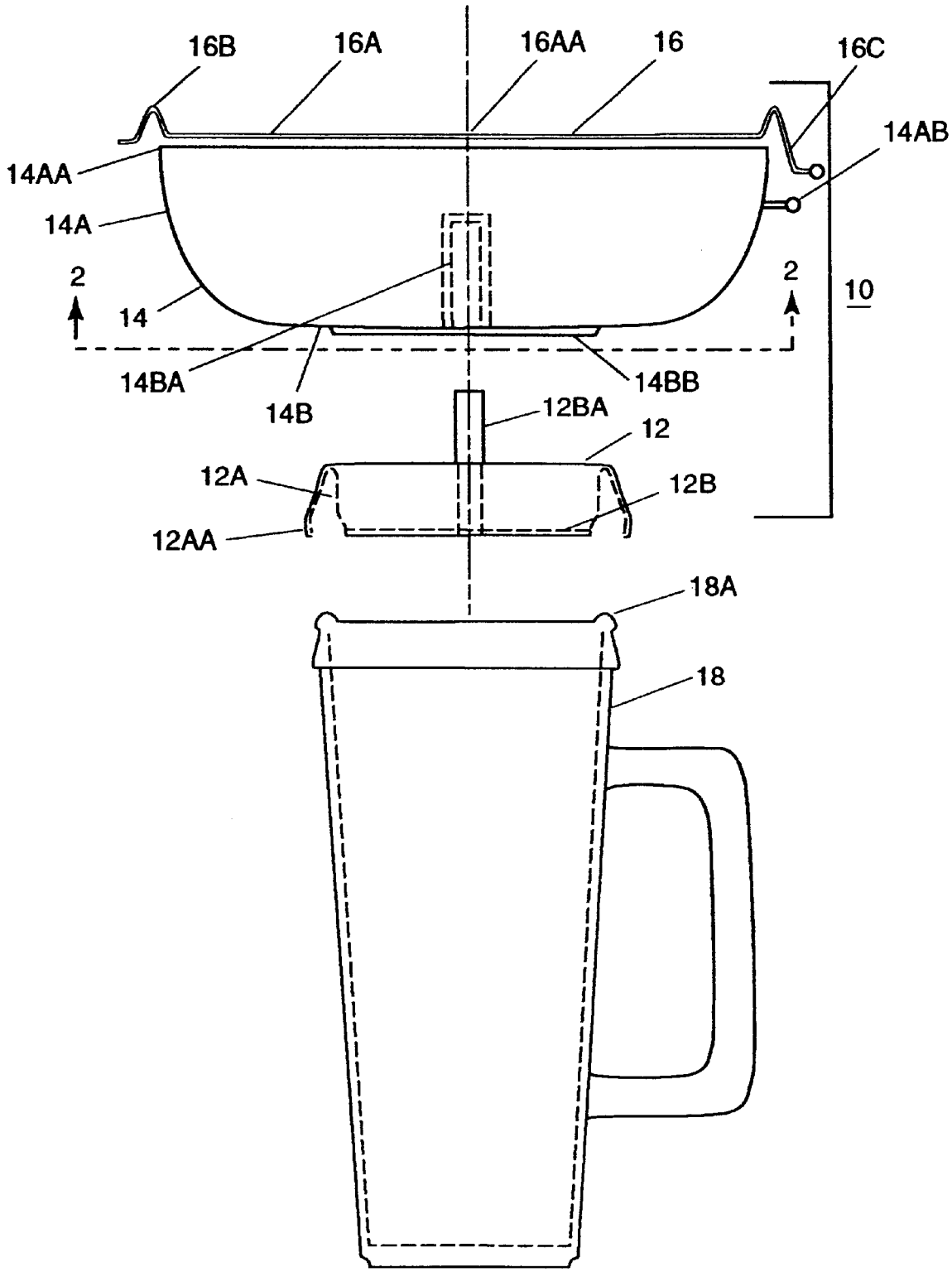
FIG. 1 is an exploded view of a beverage container cover with bowl (10) and beverage container (18).

Referring to FIG. 1 which is an exploded view of a beverage container cover with bowl (10) and beverage container (18). The beverage container cover with bowl (10) comprises a cover (12) which comprises a cover bottom (12B) having a hollow cover bottom male member (12B) extending upwardly therefrom. The cover bottom (12B) is securely sealably affixed to a cover side (12A) having a cover side lip (12AA) around a top distal edge thereof. The cover side lip (12AA) having a complementary configuration and size to a beverage container lip (18A) of a beverage container (18).

The beverage container cover with bowl (10) further comprises a bowl (14) which comprises a bowl bottom (14B) having a hollow bowl bottom female member (14BA) having a complementary configuration and size to the cover bottom male member (12B) insertable therein. The bowl (14) further comprises a bowl side (14A) having a bowl side lip (14AA) around a top distal edge thereof.

Figure 2:
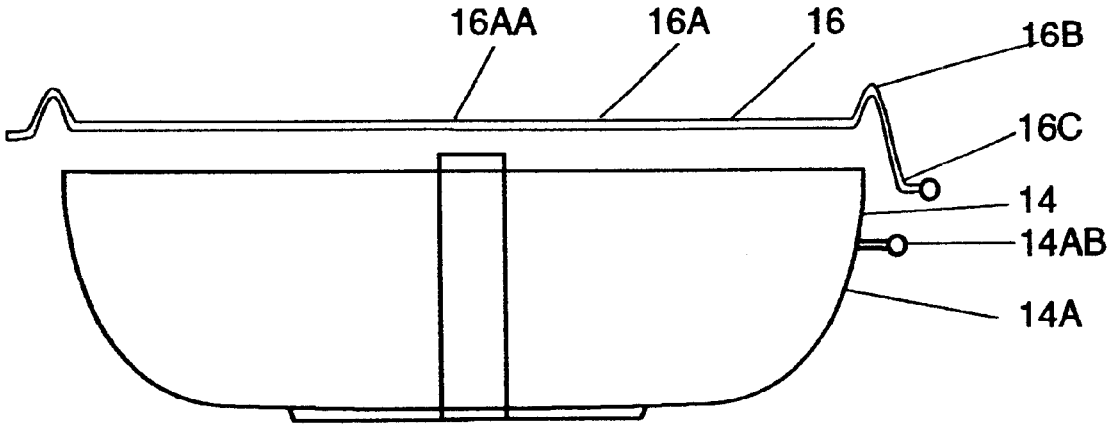
FIG. 2 is a cross sectional view along line 2—2 of FIG. 1 of a bowl (14) and lid (16).

Now referring to FIG. 2 which is a cross sectional view along line 2—2 of FIG. 1 of a bowl (14) and lid (16). The bowl side lip (14AA) further comprises a lid (16) with a lid lip (16B) removably mountable thereon. The bowl side (14A) further comprises a bowl side fastener (14AB) and the lid (16) further comprises a lid fastener (16C) having a complementary configuration to the bowl side fastener (14AB) functioning to removably attach the lid (16) to the bowl side (14A) during use. The bowl is utilized for finger food such as chips or dip etc.

Figure 3:
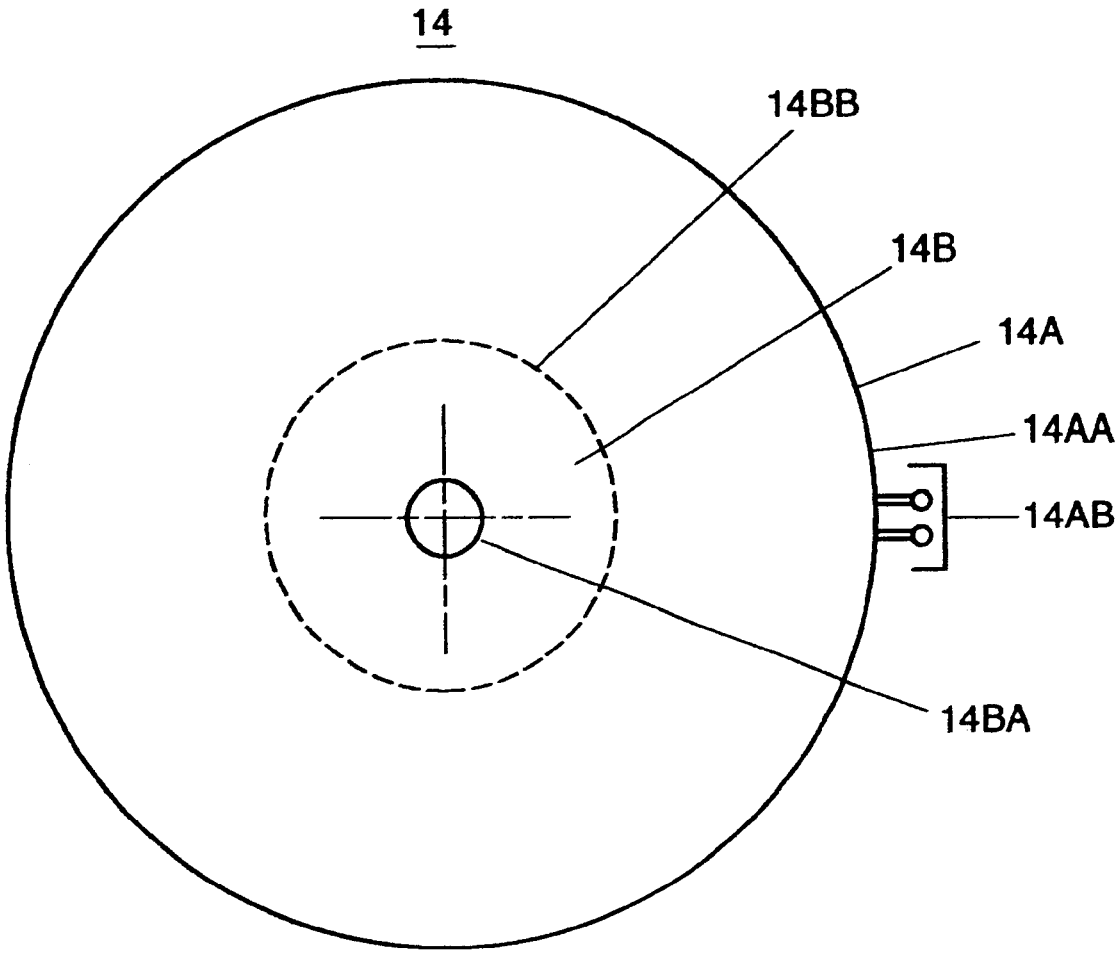
FIG. 3 is a top view of a bowl (14).

Referring to FIG. 3 which is a top view of a bowl (14). the bowl bottom (14B) further comprises a bowl bottom skirt (14BB) extending downwardly therefrom, the bowl bottom skirt (14BB) comprises a complementary configuration and diameter to the cover side (12A) removably engagable therein. The bowl side (14A) further comprises a bowl side fastener (14AB) having two straight stems each terminating in a ball configuration having a space therebetween and the lid (16) further comprises a lid fastener (16C) having one downwardly curved stem terminating in a ball configuration functioning to removably attach the lid (16) to the bowl side (14A) during use.

Figure 4:
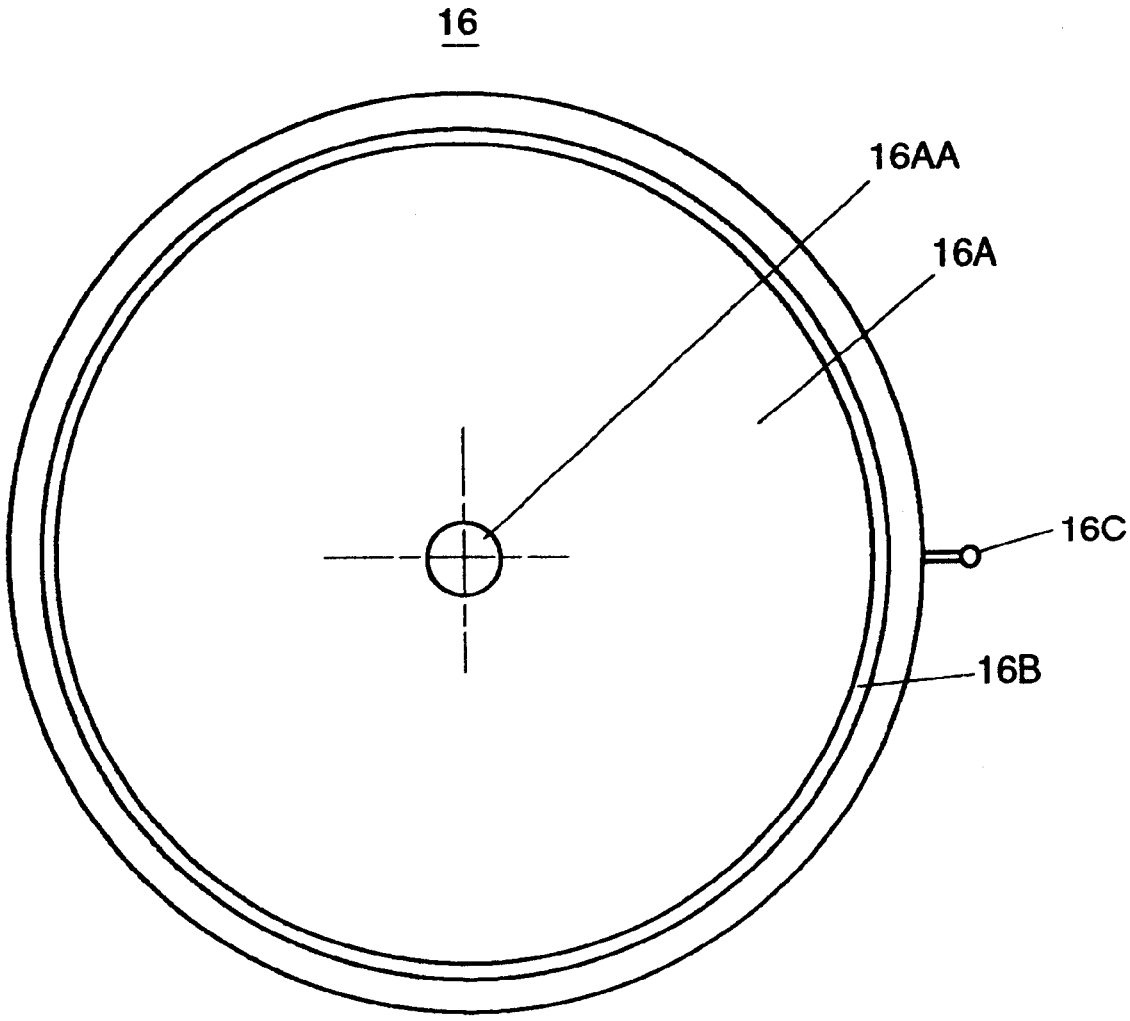
FIG. 4 is a top view of a lid (16).

Lastly, referring to FIG. 4 which is a top view of a lid (16). The lid (16) further comprises a lid top (16A) having a lid top opening (16AA) with a complementary configuration to an outer diameter of the bowl bottom female member (14BA). The user places a straw through the lid top opening (16AA), cover bottom male member (12B), and bowl bottom female member (14BA) into the beverage container (18).

It will be understood that each of the elements described above, or two or more together, may also find a useful application in other types of constructions differing from the type described above.

While the invention has been illustrated and described as embodied in a beverage container cover, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A beverage container cover with bowl (10) comprising:

A) a cover (12) which comprises a cover bottom (12B) having a hollow cover bottom male member (12B) extending upwardly therefrom, the cover bottom (12B) is securely sealably affixed to a cover side (12A) having a cover side lip (12AA) around a top distal edge thereof, the cover side lip (12AA) having a complementary configuration and size to a beverage container lip (18A) of a beverage container (18);

B) a bowl (14) which comprises a bowl bottom (14B) having a hollow bowl bottom female member (14BA) having a complementary configuration and size to the cover bottom male member (12B) insertable therein, the bowl (14) further comprises a bowl side (14A) having a bowl side lip (14AA) around a top distal edge thereof, the bowl side (14A) further comprises a bowl side fastener (14AB) having two straight stems each terminating in a ball configuration having a space therebetween; and C) a lid (16) with a lid lip (16B) removably mountable thereon, the lid (16) further comprises a lid top (16A) having a lid top opening (16AA) with a complementary configuration to an outer diameter of the bowl bottom female member (14BA), the lid (16) further comprises a lid fastener (16C) having one downwardly curved stem terminating in a ball configuration functioning to removably attach the lid (16) to the bowl side (14A) during use.

2. The beverage container cover with bowl (10) as described in claim 1, the bowl bottom (14B) further comprises a bowl bottom skirt (14BB) extending downwardly therefrom, the bowl bottom skirt (14BB) comprises a complementary configuration and diameter to the cover side (12A) removably engagable therein.

* * * * *